United States Patent [19]

McDowell

[11] Patent Number: 4,465,984

[45] Date of Patent: Aug. 14, 1984

[54] FREQUENCY SELECTIVE SIDE ABSORBER FOR A MEANDER LINE

[75] Inventor: Hunter L. McDowell, Concord, Mass.

[73] Assignee: The United States of America as represented by the Secretary of the Army, Washington, D.C.

[21] Appl. No.: 376,315

[22] Filed: May 10, 1982

[51] Int. Cl.[3] ..... H01P 1/22

[52] U.S. Cl. ..... 333/81 A; 333/161; 315/3.5

[58] Field of Search ..... 333/81 R, 81 A, 161, 333/156; 338/21, 334

[56] References Cited

U.S. PATENT DOCUMENTS 2,305,577 12/1942 Stoelting ..... 338/21
3,257,576 6/1966 Crapuchettes ..... 333/81 X
3,676,807 7/1972 Boer ..... 333/81 A
3,925,738 12/1975 Bates et al. ..... 333/161

*Primary Examiner*—Paul L. Gensler
*Assistant Examiner*—Benny Lee
*Attorney, Agent, or Firm*—Robert P. Gibson; Edward Goldberg; Jeremiah G. Murray

[57] ABSTRACT

A meander line slow wave structure mounted on ceramic bars for a microwave device such as an injected beam crossed-field amplifier includes frequency selective attenuator means which will preferentially attenuate waves at frequencies near and within the stopband of the slow wave structure by the placement of side absorber bars of attenuating material adjacent to the outer side surfaces of a plurality of meander line finger segments. The frequency selective absorber material, in its preferred form, comprises a beryllia and silicon carbide ceramic composition which additionally adapted to accommodate metallic absorber top plates, nichrome films, and slotted side ring configurations.

17 Claims, 13 Drawing Figures

FIG. 10
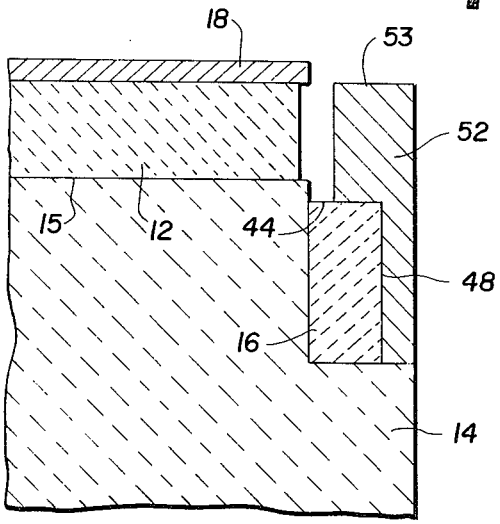
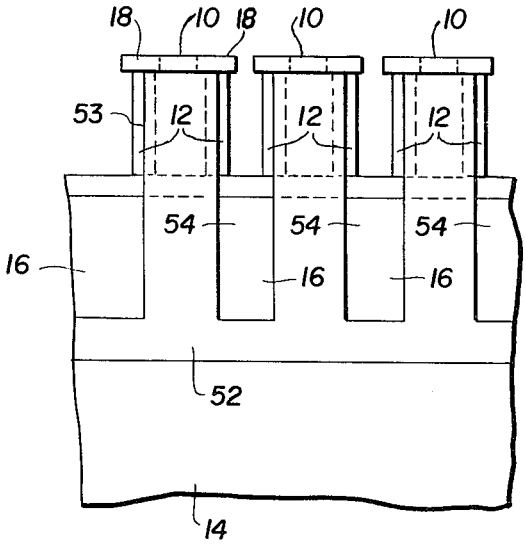
FIG. 11
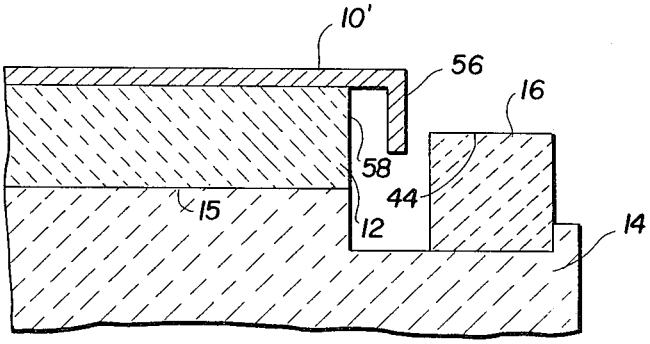
FIG. 12

FREQUENCY SELECTIVE SIDE ABSORBER FOR A MEANDER LINE

The Government has rights in this invention pursuant to Contract No. DAAB07-72-C-0273 awarded by the Department of the Army.

CROSS REFERENCE TO RELATED APPLICATION

This application is related to U.S. Ser. No. 376,314 entitled, "Broadband Slow Wave Structure", filed on May 10, 1982, in the name of Hunter L. McDowell, the subject inventor. This invention is also assigned to the present assignee.

BACKGROUND OF THE INVENTION

This invention relates generally to meander line slow wave structures and more particularly to such a structure which includes frequency selective attenuators.

Meander line slow wave structures utilized in combination with microwave devices are well known; however, such a structure is poorly matched at frequencies near the edge of the stop band which occurs above the normal operating frequency of the device employing the structure. As a result, undesirable high frequency oscillations have a tendency to build up in an injected beam crossed-field amplifier or traveling wave tube using a meander line slow wave structure. Heretofore, band edge oscillations were avoided either by limiting the tube current to a value below the start oscillation current or by making the slow wave structure dispersive so that the waves at the band edge are not synchronous with the electron beam. This resulted in a limitation either in the peak power or instantaneous bandwidth capability of the device.

Accordingly, it is the object of the present invention to inhibit band edge oscillations in a microwave device utilizing a meander line slow wave structure.

It is another object of the invention to provide a meander line slow wave structure which attenuates waves at frequencies near or within the stop band of the slow wave structure.

It is a further object of the invention to provide a broadband delay line suitable for incorporation in a high power microwave signal amplifier.

It is yet another object of the invention to provide a broadband delay line suitable for incorporation in a high power injected beam or emitting sole crossed-field amplifier which is adapted to attenuate frequencies near the edges of the pass band where undesired oscillations are likely to occur.

These and other objects are achieved by the placement of attenuating material in the form of side absorber bar type elements located adjacent the sides of a meander line slow wave structure where the attenuating material is preferably comprised of a beryllium oxide and silicon carbide ceramic composition which ranges between 60% silicon carbide and 40% beryllium oxide and vice versa. In the preferred embodiment, a 60% silicon carbide-40% beryllium oxide composition provides maximum attenuation at operation in the 10 GHz region. The side absorbers adjacent the delay line are additionally adapted to accommodate metallic top plate absorbers as well as nichrome films and slotted side rings in various configurations.

DESCRIPTION OF THE DRAWINGS

While the present invention is described in particularity for providing the basis for the claims annexed to and forming a part of this specification, a better understanding of the invention can be obtained by reference to the following description taken in conjunction with the accompanying drawings in which:

FIG. 10 is a partial cross sectional view illustrative of a fifth embodiment of the subject invention;

FIG. 11 is a partial side planar view of the side absorber and slotted side ring element utilized in the embodiment shown in FIG. 10; and FIG. 12 is a partial cross sectional view of a sixth embodiment of the subject invention.

DESCRIPTION OF THE PREFERRED EMBODIMENTS

Figure 1:
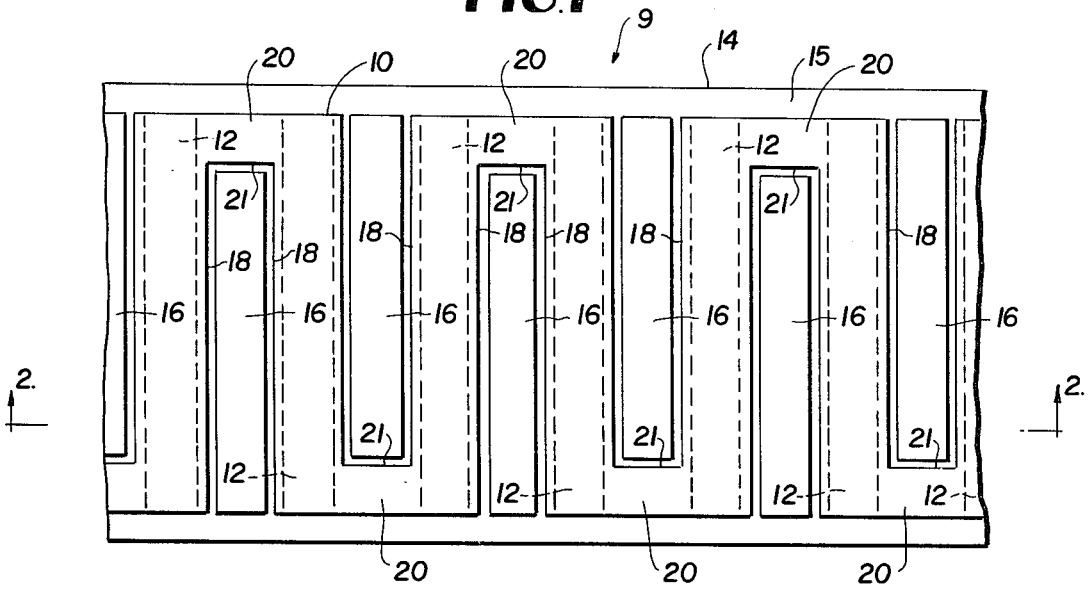
FIG. 1 is a top plan view illustrative of a meander line slow wave structure including side absorber elements in accordance with the subject invention.

Referring now to the drawings wherein like reference numerals refer to like parts, FIG. 1 is generally illustrative of a slow wave structure 9 utilized, for example, in a relatively high power microwave device such as an injected beam or emitting sole (continuous cathode) crossed-field amplifier or traveling wave tube, not shown, and comprises a metallized meander line 10 serpentine in configuration with squared corners and which is formed on a ceramic support structure comprised of a plurality of elongated bars 12 located on a base or substrate 14. The meander line is comprised of a conductive material such as copper while the support bars 12 are comprised of a beryllium oxide (beryllia) ceramic embedded in the substrate 14. The substrate 14 is also comprised of a ceramic material and additionally includes an upper conductive surface 15 which acts as a ground plane.

Figure 2:
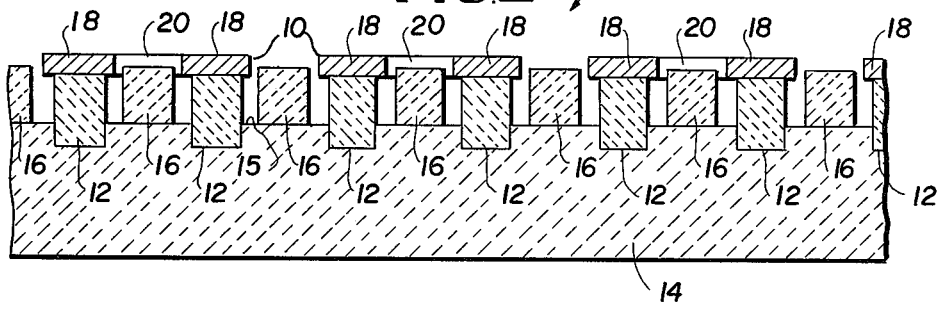
FIG. 2 is a sectional view of the embodiment shown in FIG. 1 taken along the lines 2—2 thereof.
Figure 3:
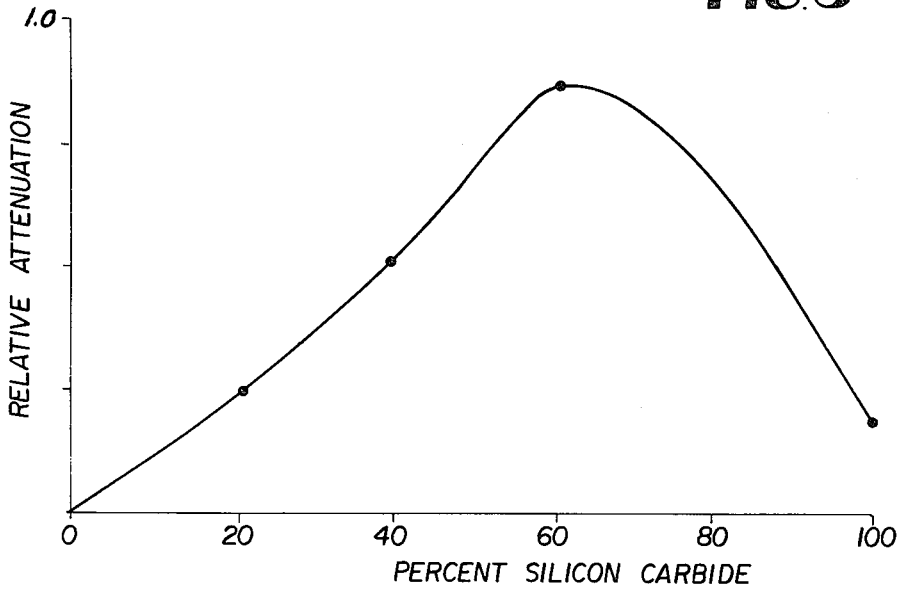
FIG. 3 is a graph illustrative of an operational characteristic of the subject invention.
Figure 4A:
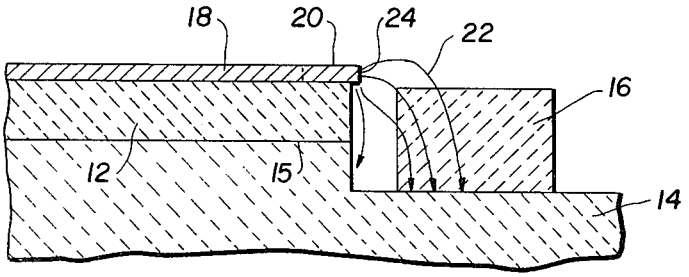
FIGS. 4A and 4B are partial sectional views of FIG. 2 which are intended to be helpful in understanding the operation of the invention.
Figure 4B:
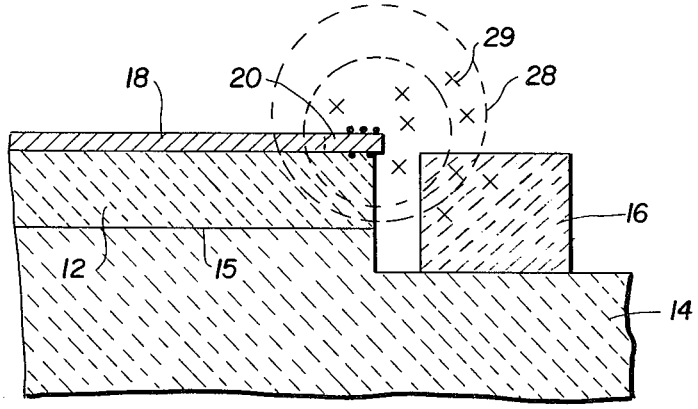

The subject invention in its simplest form comprises an embodiment wherein attenuating material is placed adjacent to the outer side surfaces of the meander line 10. As shown in FIGS. 1 and 2, which discloses the preferred embodiment, a set of side absorbers 16 are located adjacent a plurality of relatively long meander line finger segments 18 which are positioned across the width of the substrate 14 and connected in series by a plurality of relatively shorter end segments or advances 20. The side absorbers 16 take the form of elongated bar type elements positioned between pairs of finger segments 18 and an advance segment 20 and have a generally rectangular transverse cross section. The material from which the side absorbers 16 are fabricated is not necessarily frequency selective because frequency selectivity is achieved as a consequence of the RF field configuration at the sides of the meander line 10 as shown in FIGS. 4A and 4B. However, the attenuating material is preferably comprised of a beryllium oxide (beryllia) and silicon carbide composition ranging between 40% to 60% silicon carbide and conversely 60% to 40% beryllium oxide. As evidenced by FIG. 3, maximum attenuation occurs for a composition where the percentage of silicon carbide is in the order of 60%. When desirable, a carbon loaded porous alumina composition may be utilized; however, this type of material exhibits a much higher thermal resistance.

Attenuation occurs due to the coupling of RF energy to the side absorber elements 16 as an RF wave, having approximately 150° to 180° phase shift per section, traverses the meander line 10. As shown in FIG. 4A, in the transverse mode electric field lines shown by reference numeral 22 extend from the outer edge 24 of a meander line advance segment 20 to the side absorber 16. Moreover, a voltage maximum occurs at the bends 21 where the advance segment 20 meets the finger segment 18 as shown in FIG. 1. In the longitudinal mode, as shown in FIG. 4B, the current flowing in the meander line advance segment 20 generates a magnetic field, the magnetic lines of which are shown by reference numeral 28. A time varying magnetic field 28 generates an electrical field perpendicular to the page of the figure as shown by the reference numeral 29 which couples energy to the absorber 16. As in the transverse mode, the current maximum occurs at the bends 21 in the longitudinal mode. What is significant, however, is that the voltage maximum at the bends 21 exists at the lower band cut-off frequency of the slow wave structure while the current maximum exists at the bends 21 at the upper band cut-off frequency.

Figure 5:
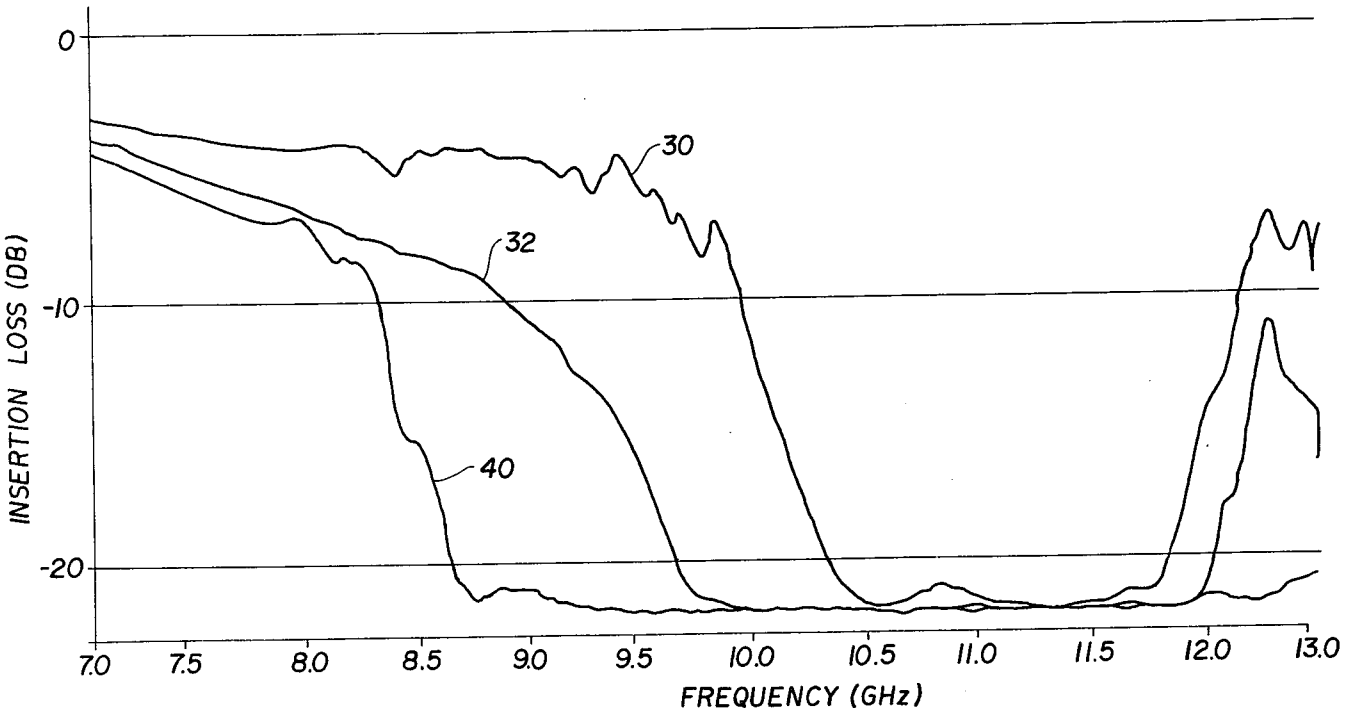
FIG. 5 is a set of graphs further illustrative of operational characteristics of the subject invention.

The effect of the side absorber elements 16 is evidenced by the set of curves shown in FIG. 5 wherein curve 30 is illustrative of the insertion loss vs. frequency characteristic of the meander line structure 10 without the absorber elements 16 while the curve 32 is illustrative of the insertion loss characteristic where the side absorber elements 16 are present. Over a frequency range of 7.0 GHz to 13.0 GHz, this frequency range includes the stop band at 180° phase shift per section, and includes the slow wave structure's lower and upper cut off frequencies (10.5 GHz and 11.7 GHz). The presence of the absorber elements 16 acts to shift the lower edge of the stop band down in frequency by 200 MHz while in addition and more importantly they add absorptive loss over frequencies near the cut off frequencies and in the stop band of the circuit. Additionally the high frequency pass band is almost completely attenuated.

Figure 6:
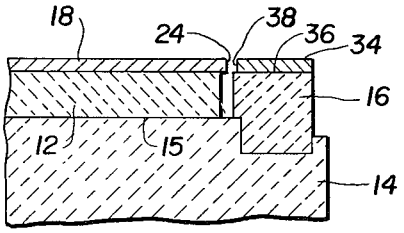
FIG. 6 is a partial cross sectional view of a second embodiment of the subject invention.

A variation of the basic embodiment shown in FIGS. 1 and 2 is illustrated in the sectional view of FIG. 6. There a top plate element 34 consisting of a layer of metal such as copper is formed on the upper surface 36 of the side absorber element 16 and whose side edge 38 is adjacent to but separated from the side edge 24 of the line segment 18 by a predetermined distance, which distance corresponds to the separation distance of the absorber element, per se, from the meander line in the absence of the top plate element 34. Typically, such a spacing is in the order of 0.005 inches for a C band delay line. The effect of the top absorber plate insofar as insertion loss is concerned, is illustrated in FIG. 5 by means of the insertion loss curve 40. The presence of the top plate element 34 operates to shift the lower edge of the stop band down in frequency by about 250 MHz with respect to the characteristic curve 32. More importantly, however, it introduces very significant amounts of absorptive attenuation at frequencies approaching the stop band. However, it has a tendency to produce a counterproductive effect at the high band cut-off frequency where it reduces the amount of absorptive attenuation as compared with the case using the absorber only. Nevertheless it still provides an improvement over a configuration where no absorbers or top plate are utilized as evidenced by the characteristic curve 30.

Figure 7:
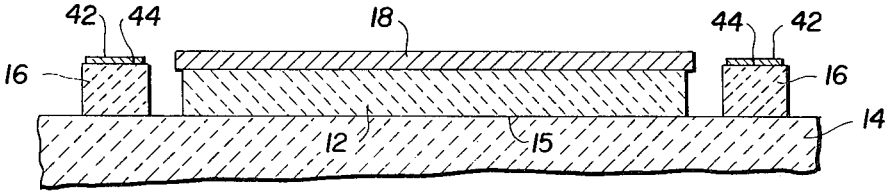
FIG. 7 is a partial cross sectional view illustrative of a third embodiment of the subject invention.

Still other embodiments are contemplated by the subject invention. For example, the absorber top plate element 34 as shown in FIG. 6 can, when desirable, be configured in the form of a resistive film 42, typically nichrome, and which is shown in FIG. 7. Where the side absorber elements 16 are comprised of a beryllium oxide or silicon carbide-beryllium oxide composition, the nichrome resistive film 42 is required to have a resistivity in the order of 100–300 ohms per square.

Figure 9:
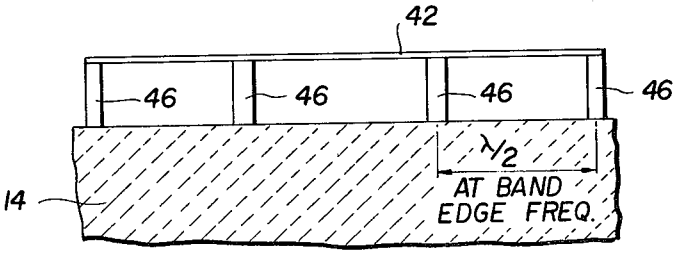
FIG. 9 is a side planar view of the side absorber element utilized in the embodiment shown in FIG. 8.
Figure 8:
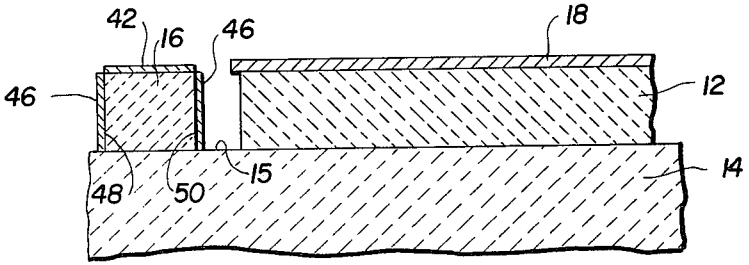
FIG. 8 is a partial cross sectional view illustrative of a fourth embodiment of the subject invention.

A more complex embodiment of a side absorber element including a nichrome film is shown in FIGS. 8 and 9 and constitutes a resonant side absorber configuration where ceramic side absorber element 16 includes not only a resistive nichrome film 42 on the top surface 44 of the bar 16, but also includes a plurality of relatively thin shunt strips of nichrome on both side walls 48 and 50 which terminate in the conductive surface 15 of the substrate 14. The distance separating the shunt strips 46 is made to be one half wavelength at the band edge frequency where selective attenuation is desired. With respect to the resistivity of the strips 46, if a Q of the resonator resulting from the combination of the ceramic elements 16 and the top film 42 along with the side conducting strips 46 is in the order of 10, then the nichrome film of the strips 46 will have a resistivity in the order of 1 ohm per square.

Because the absorber elements 16 form electrical insulators when comprised of beryllium oxide silicon carbide ceramic compositions, there is a possibility that these elements can become charged due to the interception of beam current from the amplifying device with which they are utilized. One approach to obviate this effect is to recess the upper surface 44 of the side absorber element 16 with respect to the upper surface 15 of the substrate 14. However, where additional concern about the possibility of charging the ceramic elements exists, a resort to an embodiment as shown in FIGS. 10 and 11 can be had. The configuration there involves a slotted side ring member 52 along with a recessed absorber bar 16. The slotted side ring 52 is adapted to partially cover the upper and side surfaces 44 and 48 of the ceramic absorber elements 16 as shown in FIG. 10. The slotted ring member 52 is comprised of metal and includes upwardly projecting portions 53 which extend to the lower edge of the meander line 10. The side ring, moreover, is configured to have a multiplicity of slots 54 which exist for every two meander line finger segments 18. Such a configuration in effect comprises a second slow wave structure which is coupled to the main slow wave structure 9. Accordingly, in order to obtain the desired degree of coupling, it is necessary for the phase shift per circuit section of this adjacent structure, namely the ring member 52, to be equal to that of the meander line. This accounts for one slot 54 for every two meander line finger segments 18. Such a structure can be forced to have a zero mode corresponding to that on the side of the meander line when the slots are approximately one half wavelength long. The transverse coupling at the lower band cut off leads to a parallel plate transmission line between the side plate and the base or substrate 14. The slots 54 in the side ring member 52 do not effect this mode and accordingly the top edge of the lower pass band is attenuated by the slotted side ring configuration. To attenuate the upper band cut off, the slots in the side ring member 52 must be designed so that the slots are loaded by the ceramic absorber material of the elements 16 so that the zero mode of the slotted plate element corresponds to the upper band cut off frequency. In addition the amount of attenuation on the slotted ring member 52 must be such as to obtain a critical degree of damping since too much attenuation will cause decoupling of the slotted ring member.

Another and relatively more simple configuration for avoiding the possibility of charging the absorber elements 16 is to utilize an embodiment such as shown in FIG. 12 where the side absorber element 16 is moved away from the line support bar 12 by the utilization of a folded meander line 10' which includes a right angled end portion 56 which extends downwardly between the upper surface 44 of the side absorber element 16 and the outside surface 58 of the ceramic support bar 12.

Having thus shown and described what is at present considered to be the preferred embodiments of the subject invention, it should be noted that the foregoing detailed description has been made by way of illustration and not of limitation. Accordingly, all changes, modifications and alterations coming within the spirit and scope of the invention as defined in the appended claims are herein meant to be included.

1. A slow wave structure adapted to selectively attenuate predetermined frequencies in the region of the stopband of said structure, comprising in combination:

longitudinal substrate means of dielectric material having an upper conductive surface;

a plurality of spaced parallel support members of dielectric material embedded in and extending above and across the width of said substrate means;

meander line circuit means including an electrical conductor having spaced parallel conductor members extending across said width and located on said support means and having connecting longitudinal members between alternate ends of said conductor members to form a continuous serpentine pattern; and a plurality of separate spaced parallel attenuator members of dielectric material located on said substrate means between pairs of adjacent support members and spaced from said conductor members and support members.

2. The slow wave structure as defined by claim 1 wherein said attenuator members are comprised of a ceramic material different from said substrate and support materials.

3. The slow wave structure as defined by claim 2 wherein said ceramic material comprises a composition of beryllium oxide and silicon carbide.

4. The slow wave structure as defined by claim 3 wherein said composition of beryllium oxide and silicon carbide ranges substantially between 40% beryllium oxide and 60% silicon carbide and vice versa.

5. The slow wave structure as defined by claim 4 wherein said composition comprises 40% beryllium oxide and 60% silicon carbide.

6. The slow wave structure as defined by claim 2 wherein said ceramic material comprises a carbon loaded porous alumina composition.

7. The slow wave structure as defined by claim 2 wherein said support means comprises a plurality of ceramic support elements underlying said meander line circuit means.

8. The slow wave structure as defined by claim 7 wherein said ceramic support elements are comprised of beryllium oxide.

9. The slow wave structure as defined by claim 2 wherein said serpentine conductor pattern is comprised of a plurality of elongated conductor segments connected in series by a plurality of relatively shorter conductor segments forming a composite structure thereby and wherein said attenuator members comprises a plurality of elongated bars of ceramic material located intermediate adjacent pairs of said plurality of elongated conductor segments.

10. The slow wave structure as defined by claim 9 wherein said elongated bars are generally rectangular in cross section and having a respective upper surface which is located below the upper surface of the adjacent elongated conductor segments.

11. The slow wave structure as defined by claim 9 wherein said elongated bars of ceramic material are generally rectangular in cross section and having a respective upper surface which additionally includes a metallic conductor plate formed thereon.

12. The slow wave structure as defined by claim 9 wherein said elongated bars of ceramic material are generally rectangular in cross section and having a respective upper surface which additionally includes a resistive film formed thereon.

13. The slow wave structure as defined by claim 12 wherein said resistive film is comprised of nichrome.

14. The slow wave structure as defined by claim 12 wherein said elongated bars additionally include a pair of opposing side surfaces having a plurality of shunt resistive strips formed thereon between said resistive film and said substrate means.

15. The slow wave structure as defined by claim 14 wherein said shunt resistive strips are mutually separated by one half wavelength at the band edge frequency where selective attenuation is desired.

16. The slow wave structure as defined by claim 14 wherein said resistive film and said shunt strips are comprised of nichrome.

17. The slow wave structure as defined by claim 10 and additionally including a slotted side slide ring member located contiguous to said bars and extending upwards toward the upper surface of said conductor segments and including a plurality of slots spanning pairs of conductor segments.

* * * * *